United States Patent [19]

Weber et al.

[11] 4,021,028

[45] May 3, 1977

[54] TILTABLE TREATMENT TABLE

[75] Inventors: Albert J. Weber; Frank H. Erling; Clair A. Bearfield, all of Valley City, N. Dak.

[73] Assignee: Tri W-G, Inc., Valley City, N. Dak.

[22] Filed: Mar. 29, 1976

[21] Appl. No.: 671,071

[52] U.S. Cl. ..... 269/325
[51] Int. Cl.[2] ..... A61G 13/00
[58] Field of Search ..... 269/322–326; 5/62, 66–69; 250/439–456

[56] References Cited

UNITED STATES PATENTS

| | | | |
|---|---|---|---|
| 3,089,692 | 5/1963 | Blomquist | 269/323 |
| 3,200,416 | 8/1965 | Warrick | 269/325 |

FOREIGN PATENTS OR APPLICATIONS

| | | | |
|---|---|---|---|
| 505,030 | 4/1920 | France | 269/324 |

*Primary Examiner*—Al Lawrence Smith
*Assistant Examiner*—Robert C. Watson
*Attorney, Agent, or Firm*—Schroeder Siegfried Ryan & Vidas

[57] ABSTRACT

A tiltable treatment table in which the table member is pivotally mounted on an upstanding support frame through a suitable pivot structure which includes torsional counterbalance springs to counterbalance the weight of the patient and permit ready manual adjustment and displacement or tilt of the table relative to the support frame. The treatment table includes an intermediate tilt section or thoriac section which may be displaced relative to the main table and held rigidly in position through telescopic adjustment members which lock together through an eccentric mechanism.

13 Claims, 5 Drawing Figures

200
54
200
10
142
170
198
195
164
165
142
172
198
195
185
140
175
190
176
162
140
58
55
58
152
150
176
160
135
92
94
90
70
69
68
45
205
45
28
65
80
100
66
65
97
82
112
85
107
25
30
26
95
56
87
130
105
115
116
118
92
106
25
22
20
125
120
22
140
170
198
195
185
193
180
190
178
182
175
140
170
185
198
193
195
180
192
190
182
178
175

TILTABLE TREATMENT TABLE

Our invention relates to a treatment table and more particularly to an improved tiltable treatment table which may be manually tilted with portions of the same articulated with respect to the remaining portion of the table through a simple manual adjustable means.

Treatment tables and particularly tiltable tables are well known and in use. They may be manually or machine operated. In the improved tiltable treatment table of the present invention, simplified tilting support is provided by means of which a patient may be tilted through a 90° quandrant manually and with spring counterbalance to offset the weight of the patient and in which a portion of the table may be tilted or otherwise adjusted with respect to the remainder of the table through a simplified adjustable means and held rigidly in the position of adjustment to support the weight of the patient. The improved tiltable table utilizes offsetting balance springs in the pivot structure for simplifying the manual operation of tilt. In addition, a portion of the table may be movable relative to the remaining portion to adjust for varying positions of patient treatment through a simplified manually adjustable means which incorporates an eccentric mechanism operating upon the telescopic parts to positively clamp the parts in an adjusted relationship and readily release the same for adjustment.

It is therefore the object of this invention to provide an improved tiltable treatment table with a simplified means for balancing the same.

Another object of this invention is to provide a manually tiltable treatment table readily adjustable for a wide range of positions.

Another object of this invention is to provide an improved table of this type in which a portion of the table may be positioned relative to the remainder of the table through a simplified manual adjustment means.

A still further object of this invention is to provide an improved manually adjustable means in the form of telescopic parts held in a relative position by a frictional engagement of a pin pivotally movable toward and away from the parts through a simplified eccentric mechanism.

These and other objects of the invention will become apparent from the reading of the attached description together with the drawings wherein.

Figure 1:
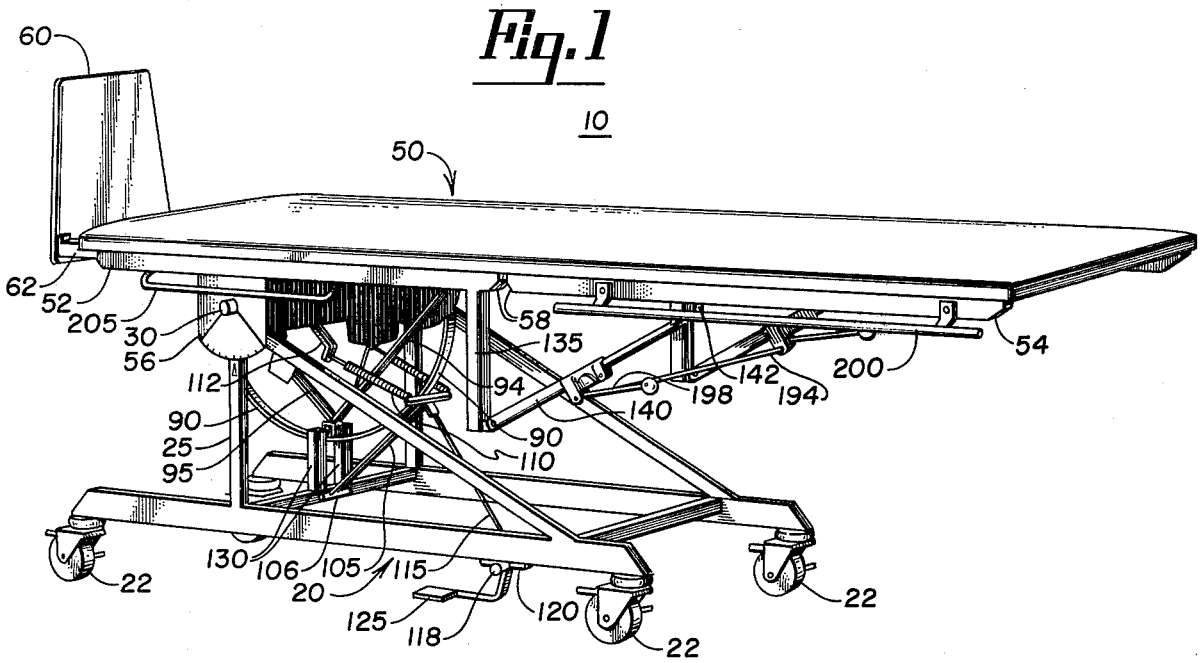
FIG. 1 is a perspective view of the table in a horizontal position.
Figure 2:
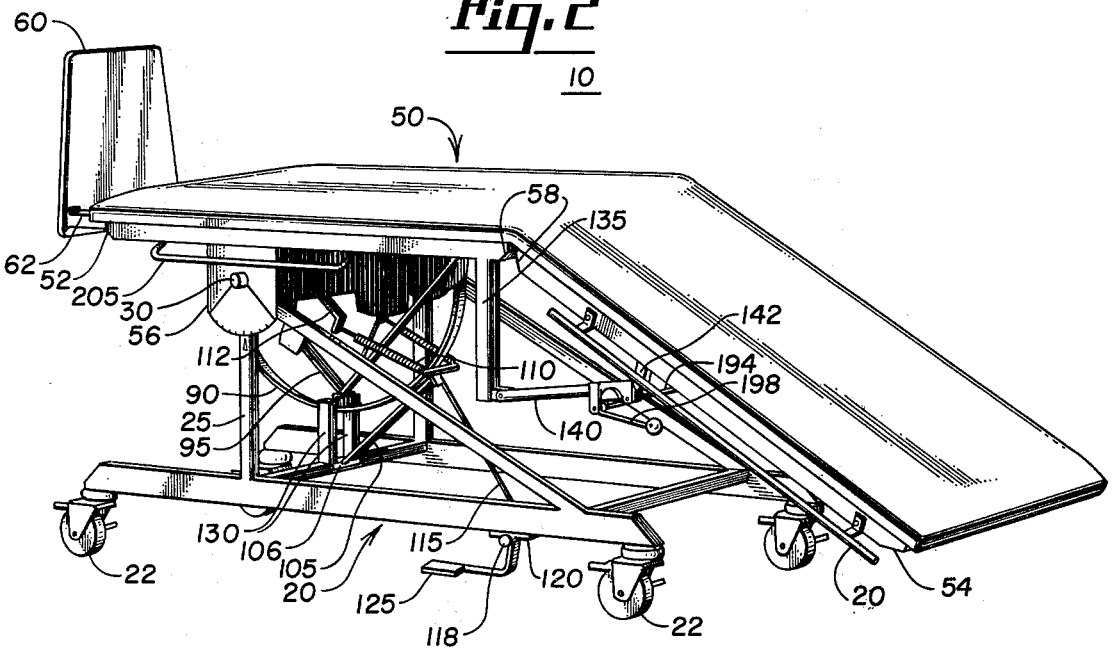
FIG. 2 is a perspective view of the table with a portion adjusted relative to the remainder of the table.
Figures 3, 4, 5:
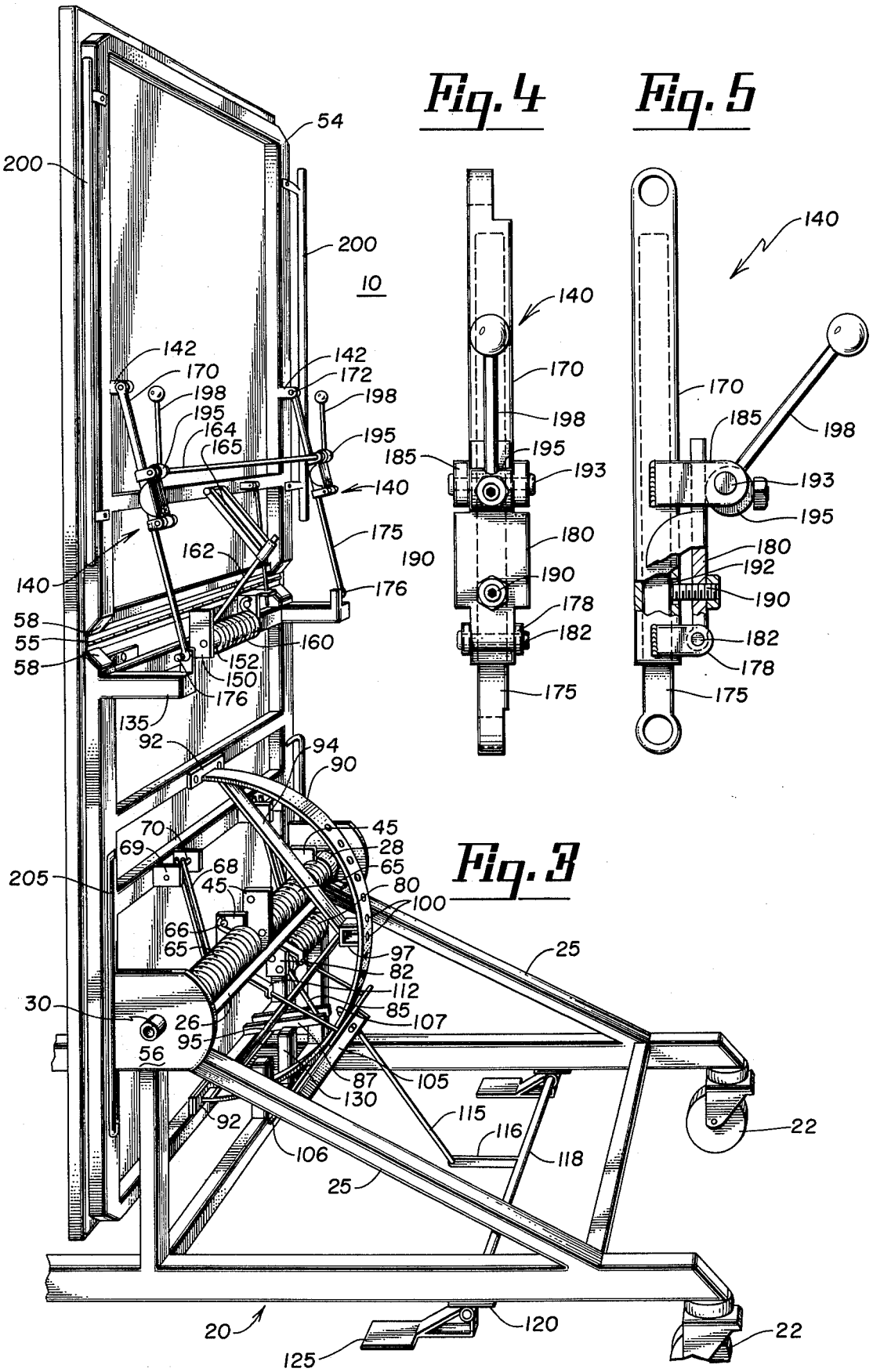
FIG. 3 is a perspective view of the table in a complete tilted position and without a foot rest.
FIG. 4 is a bottom view of the adjustable linkage.
FIG. 5 is a side elevation view of the adjustable linkage.

The tiltable treatment table of the present invention is shown generally at 10 in perspective in a horizontal position in FIG. 1. In FIG. 2, the table is again shown in the horizontal position with the thoracic section tilted with respect to the remainder of the table. In FIG. 3, the table is shown tilted to a vertical position. The table includes a base section 20 having a lockable castered wheels 22 on the base of the same and an upstanding frame portion 25 generally triangular in form secured to the base. This upstanding support includes a cross brace member 26 which ties the two triangular shaped side supports together as an integral unit. Positioned in the upper end of the triangular shaped supports are bearing members shown at 28 which journal the shaft 30 mounting the table member 50 of the treatment table. The table member 50 has metal support frames 52 and 54 attached to the undersurface of the same and a hinge section 55 pivoting the table member along its extent to provide the thoriac section. The frame part 52 mounts downwardly extending flanges 56 which carry the ends of the shaft 30 which pivots the table member on the upstanding support or in the bearings 28 therein. The cross brace member 26 has secured thereto a plurality of flange members 45 which are welded thereto to suitably secure them to the metallic frame formed by the base 20 and upstanding support frame 25. The table member is actually a covered cushion member having a wooden base or support 40 which the metallic frame members 52, 54 are connected with the hinge 55 joining the wooden base portion of the cushion or table member which may be pivoted along the hinge line without interference of the frame members. Also connected to the frame 52 and slidably mounted therein is a second frame 62 of the foot rest member 60 (omitted in FIG. 3) which foot rest is manually adjustable and connected to the frame 52 to permit the patient or subject to stand thereon and be tilted on the treatment table.

The shaft 30 carries a plurality of coil springs 65 which coil springs are connected at one end to the flange members 45, as indicated at 66, with the opposite end of the coil springs having a straight section 68 which bear against the flange members 69 and a cross pin 70 secured to the frame part 52. Thus, the four coil springs mounted on the rod 30 are tied at one end through the flange members 45 to the base and at the other end the straight extension 68 bears against the table member at the flanges and pins 69, 70, on the under surface of the same biasing the table member to a vertical position with respect to the support frame. An additional coil spring 80 is carried by a shaft positioned between flanges 82, connected to the base frame with one end of this coil spring being secured to the flange members and the other or straight end of the same, as indicated at 85, being connected to a pair of parallel flange members 87 carried by the table. This coil spring biases the table in the opposite direction to that of the springs 65 and in the vertical position will aid in initially tilting the table toward the horizontal position.

The undersurface of the table member or the main portion under the frame part 52 carries a semicircular bale member 90 which is secured at its extremitites through flange members 92 to the undersurface of the metallic frame 52. Suitable cross bracing 94, 95 extend from the flanges 92 to a "U" shaped bracket member 97 secured at the center of the bale. The bale has a plurality of apertures 100 distributed along its extent, and a pivoted lever member 105 which is pivoted on the base frame through a pivot member 106 and which carries a pin 107 at the free end of the same, the pin being adapted to be positioned through the apertures 100 in the bale member to adjust the position of the table member relative to the base support. The pivoted lever is urged into engagement with the bale through a pair of springs 110 which are carried by suitable flanges 112 connected to the cross brace 26 of the upstanding support frame. A link 115 is connected to the free end of the pivoted member 105 and connects at its other extremity through a flange 116 carried by a shaft 118 journaled on the under surface of the frame, as at 120, and having foot pedals 125 connected thereto. Thus, the foot pedals may be deflected to pivot the shaft and hence, the flange 116 pulling the tie rod down to pivot the lever 105 away from the bale and releasing the pin 107 from one of the apertures. With the subject thereon, the table may be manually adjusted or positioned about the pivotal connection between the shaft 30 and the bearings 28 in the upstanding frame and against the pressure of the springs 65 or 80 to adjust the position to the table member relative to the upstanding support frame through a 90° angle in which the table, as indicated in FIG. 3, is substantially vertical to a position in which the table is horizontal as indicated in FIG. 1. A series of graduated steps of adjustment through this 90° displacement, permits the treatment table to be tilted under manual operation of an operator and with a patient thereon for various treatment positions. Suitable upstanding flange members 130 mounted on the base frame and spaced apart, guide the bale member 90 in its pivoted movement to prevent any translational displacement of the same.

In addition to the tilt of the table member generally about the support frame, the table member 50 itself pivots or is adjustable along its extent. The main portion carries the pivots which supports it on the base structure. A thoriac section is coupled to the frame part 54 which pivots relative to the main section. Thus, as will be seen in FIG. 3, the frame part 52 includes downwardly extending flange section 135 which mounts one end of a pair of telescopic adjustment members, indicated generally at 140, the adjustment members being coupled to similar flange members 142 connected to the support frame 54. In addition the frame 52 also carries or mounts flange members 150 having a suitable shaft 152 extending therebetween which shaft carries a torsion spring 160 secured at one end to the flange members 150 and having a straight section 162 coupled through a pivoted linkage member 165 to the frame 54 of the table member. Adjusting members 140 will best be seen in FIGS. 4 and 5 as being formed of a pair of telescopic parts 170, 175, the part 170 being an outer telescopic part and being journaled at one extremity to the flange members 142 through pivots 72. The inner telescopic part member 175 is similarly connected to the flanges 135 through pivotal couplings 176. The other telescopic part member includes a pair of spaced flanges 178 which carry a pivoted lever 180 thereon, the lever being pivoted as at 182 on the flanges 178. A second pair of upstanding flange members 185 are positioned on the outer telescopic member and to either side of the pivoted lever 180 with the lever 180 carrying an adjustable bolt or pin 190 projecting through an aperture 192 on the outer telescopic part member 170 and bearing against the inner telescopic part member. The flange members 185 mount pinlike stubs 193 of an eccentric member 195 having a handle 198 projecting therefrom and bearing against the end of the pivoted lever 180. The eccentric or cam surface when rotated on its pivots 193 will cause the lever 180 to pivot and urge the pin 190 carried thereby into engagement with and clamping the inner telescopic part member 175 to the outer telescopic part member 170. The eccentric members 195 are tied together by a shaft 164 extending between the adjustment members 140 so that rotation of one member 195 through a handle 198 will rotate the other release or lock both members simultaneously from either side of the table. The eccentric members 195 may be rotated to an over-center camming position to be substantially parallel with the pivoted lever for a maximum deflection of the lever or rotated in a counter-clockwise direction as seen in the drawings to release the pivoted lever and allow the telescopic parts to telescope. These telescopic parts may be circular or square in cross section and operate to adjust the position of the deflectable in a position of adjustment so that it may support the weight of the patient.

To aid in the movement of the table in a tilting direction and also in the break section, suitable hand grips 200 and 205 are connected to the frame parts 54, 52 respectively, so that the operator may grip the same in readily tilting the table or to adjust the table sections relative to one another, Although not shown it will be understood that the foot section 60 may be slidably mounted to the main table and adjustably positioned thereto through similar adjustment mechanism and members 140 or the treatment table or separate components from the same other than the foot rest may be adjusted in the same manner and held rigidly in position.

Therefore, in considering the invention it should be remembered that the present disclosure is illustrative only and the scope of the invention should be determined by the appended claims.

What we claim is:

1. A tiltable treatment table comprising, a ground engaging support having an upstanding support frame; pivot means positioned at the top of the support frame; a flat table member pivotally mounted on the pivot means to pivot the table member on the upstanding support frame; torsion spring means associated with the pivot means and adapted to bias the table to a position normal to the ground engaging support; adjustable means included in part in the table means and in part in the support frame to hold the table in varying angular positions with respect to the upstanding support frame; said table member having main and second portion coupled together through a pivot means for pivoting the second portion on the main portion; an adjustable brace means coupled between the main and the second portions of the table member to adjustably position the portions and hold the main and second portions of the table member in a desired angular relationship to one another; said adjustable brace means including a pair of telescopic struts with the outer strut having a pivoted lever mounted and carrying a pin which pin is adapted to project through an aperture in the outer strut and frictionally engage the surface of the inner strut; and an eccentric cam forming a part of said adjustable brace mounted on the outer strut and contacting the pivot lever at the free extremity to move the pin toward and away from the inner strut.

2. The tiltable treatment table of claim 1 in which the adjustable brace means includes pairs of telescopic strut members to each side of the second portion of the table member with said pairs cooperating with said pivot means to adjust and hold the second portion of the table member with respect to the main portion.

3. A tiltable treatment table of claim 2 and including spring means associated with the pivot means between the main and second portions of said table member and adapted to bias said second portion into alignment with the main portion of the table member.

4. The tiltable treatment table of claim 1 in which the pivot means mounting the flat table member on the upstanding support frame includes shaft means mounted on the upstanding support and extending through flange means connected to the flat table member with the torsion spring means positioned around the shaft and connected at one extremity thereto with the other extremity bearing against the flat table member.

5. The tiltable treatment table of claim 4 in which the adjustable means included in part on the table member and in part on the base structure includes a semi-circular bale with apertures therein connected to the flat table member and cooperating shaft means with a pin thereon positioned on the upstanding frame and with the pin adapted to selectively be moved toward and away from the bale to project into apertures in the bale for the purpose of fixing the position of the table member relative to the upstanding support frame.

6. A tiltable treatment table comprising, a ground engaging support having an upstanding support frame; pivot means positioned at the top of the support frame; a flat table member pivotally mounted on the pivot means to pivot the table member on the upstanding support frame; torsion spring means associated with the pivot means and adapted to bias the table to a position normal to the ground engaging support; adjustable means included in part in the table means and in part in the support frame to hold the table in varying angular positions with respect to the upstanding support frame; said table member having a main and a second portion coupled together through a pivot means for pivoting the second portion on the main portion; an adjustable brace means coupled between the main and the second portions of the table member to adjustably position the portions and hold the main and second portions of the table member in a desired angular relationship to one another; said adjustable brace means including pairs of telescopic strut members connected respectively between the second portion of the table member and the main portion with the telescopic struts including an outer strut having a pivoted member mounted thereon and carrying a pin which pin projects through an aperture in the outer strut member and frictionally engages the surface of the inner strut member; and a pivoted cam means connected to a lever and journaled on the outer strut with the cam means engaging the end of the pivoted lever and adapted to be rotated through a rising cam surface to an over-center position wherein the cam means will be locked against further rotation and urge the pivoted lever with the pin thereon toward said inner strut.

7. The tiltable treatment table of claim 6 in which the pin mounted on the pivoted lever is a threaded screw member which is adjustably positioned thereon to vary the length of the projection into the aperture and in contact with the inner strut member.

8. The tiltable treatment table of claim 5 in which the base includes pivoted caster members as the ground engaging support and with an adjustable foot plate slidably mounted in one end of the table member and including pedal operated shaft means mounted on said frame and coupled to the shaft and pin cooperating with the bale in the adjustment means in the position of the treatment table.

9. The tiltable treatment table of claim 8 and including additional torsion spring means connected between the upstanding support frame and the table member and applying the bias to the table member opposite the bias of the first named torsion spring means.

10. The treatment table comprising, a base section having an upstanding support frame; a table member mounted thereon and including a plurality of parts at least one of which is pivotally connected to an adjoining part, an adjustable brace means connected between said one part and said adjoining part and including outer and inner brace members which telescopically fit together and slide relatively to one another to adjust the relative angular position of said parts, said brace means further including a pivoted lever member attached to said outer brace member and a crank operated adjustable cam associated with the pivoted lever member, an adjustable screw means carried by the pivoted lever member and extending through an aperture in the outer brace member to contact the inner brace member with the crank operated adjustable cam having an over center position in which the pivoted lever member is deflected toward said inner brace member.

11. The treatment table of claim 10 in which the telescopic members are squre in cross section.

12. The treatment table of claim 10 in which the telescopic members are cylindrical in cross section with the inner member having a flat surface thereon.

13. The treatment table of claim 10 in which the brace means includes said brace members positioned near the outside edges of the parts of the table member and in which the pivotal connection between the parts includes bias means urging said parts into an aligned relationship.

* * * * *